US006457820B1

(12) United States Patent
Cai et al.

(10) Patent No.: US 6,457,820 B1
(45) Date of Patent: Oct. 1, 2002

(54) FACILITY AND METHOD FOR REMOVING GAS BUBBLES FROM AN INK JET PRINTER

(75) Inventors: Edward Z. Cai; Ravi Prasad; Isaac Farr; Jenny Li, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/885,225

(22) Filed: Jun. 19, 2001

(51) Int. Cl.[7] ..... B41J 2/19
(52) U.S. Cl. ..... 347/92
(58) Field of Search ..... 347/85, 86, 87, 347/92, 89

(56) References Cited

U.S. PATENT DOCUMENTS 4,940,995 A 7/1990 Hine et al. ..... 347/89
4,995,940 A 2/1991 Hine et al. ..... 156/629
5,808,643 A 9/1998 Tracy et al. ..... 347/92
5,936,650 A * 8/1999 Ouchida et al. ..... 347/89
5,940,104 A * 8/1999 Karita et al. ..... 347/87
6,116,726 A 9/2000 Driggers ..... 347/87

* cited by examiner

*Primary Examiner*—Anh T. N. Vo

(57) ABSTRACT

A printer has a print engine with an ink supply chamber connected to the print engine. The supply chamber has an exit aperture to which a suction device is connected. A gas permeable film associated with the aperture separates the chamber from the suction device. The suction device may be a resilient spring member that occasionally is composed during winter carriage reciprocation to maintain suction, or may be a vacuum pump. A porous may support the film.

4 Claims, 3 Drawing Sheets

FACILITY AND METHOD FOR REMOVING GAS BUBBLES FROM AN INK JET PRINTER

FIELD OF THE INVENTION

This invention relates generally to ink jet printing, and more particularly to the evacuation of gas bubbles from ink jet ink delivery systems.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled onto the surface to generate a desired pattern. The pen includes a body defining an ink chamber containing a supply of ink. The pen may be supplied by a detachable and replaceable ink cartridge, or via a flexible tub to a fixed supply, which also may be replaceable.

An issue of concern for these and other liquid ink printers is the unwanted introduction of air bubbles. Air or other gas may occur for various reasons. A printer may initially be manufactured and shipped to the end user with empty, air-filled chambers and conduits in which ink will normally reside, and which is displaced into an ink pen upon startup. The replacement of an ink supply cartridge may trap and introduce additional air. Ink may contain dissolved gas that generates bubbles. If gas bubbles are not evacuated or otherwise accommodated by design, they can block the flow of ink. Where such devices are subject to atmospheric temperature and pressure fluctuations, an expanding bubble may displace ink from the print head orifices, drool ink over the paper, and leaving residual dried ink that impairs print quality.

Past systems have addressed gas entrapment by warehousing the gas in tolerable areas of the ink supply system, providing adequate volume for gas expected to accumulate over the life of the device. However, these undesirably increase device size, and may be inadequate for devices expected to have a long life through many replacements of the ink supply cartridges. Degassed ink may be used to eliminate one source of gas, but it suffers the disadvantage of limiting the shelf life of the ink supply cartridges. Another approach is to provide a gas pumping system that engages in pumping of a volume from the system, but which is unable to distinguish between ink and gas, and therefore is prone to waste of ink, in addition to the complexity, size, and cost associated with such systems.

There is therefore the need for mechanisms which facilitate the removal of gas from ink delivery systems, and which do not add excessive cost or complexity to the ink delivery system.

SUMMARY OF THE INVENTION

Embodiments of the present invention provide a suction device connected to the ink supply chamber of an inkjet printer. The supply chamber and print engine have exit apertures to which a suction device is connected. A gas permeable film associated with the aperture separates the chamber from the suction device. The suction device may be a resilient spring member that occasionally is compressed during printer carriage reciprocation to maintain suction, or may be a vacuum pump. A porous element may support the film.

Other aspects and advantages of the present invention will become apparent from the following detailed description, taken in conjunction with the accompanying drawings, illustrating by way of example the principles of the invention.

DETAILED DESCRIPTION OF A PREFERRED EMBODIMENT

Figure 1:
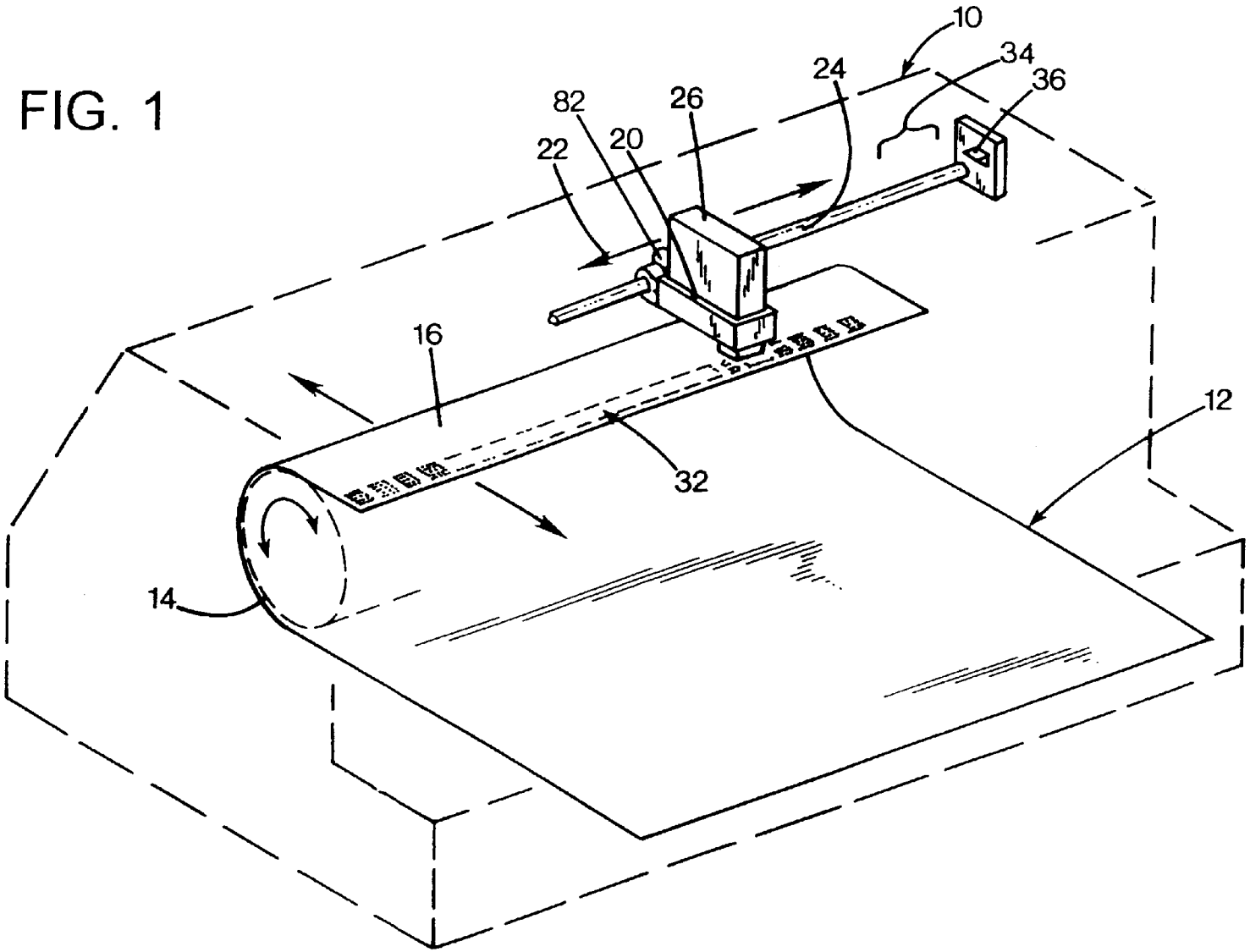
FIG. 1 is a perspective view of a printer according to a preferred embodiment of the invention.

FIG. 1 shows an ink jet printer 10 into which a sheet of printer media 12 has loaded. The printer has a media drive mechanism 14 that feeds the sheet along a paper path, with motion of the sheet defining a feed axis 16. A print head carriage 20 reciprocates along a scan axis 22 on a guide rod 24, and carries a print cartridge or pen 26 that expels ink droplets onto the media surface to generate a desired printed image 32.

Between print jobs, the carriage rests beyond the normal path of transit at a service location 34. At or beyond the service station is a protruding stop element 36 that is to operate a gas evacuation facility on the pen as discussed below.

Figure 2:
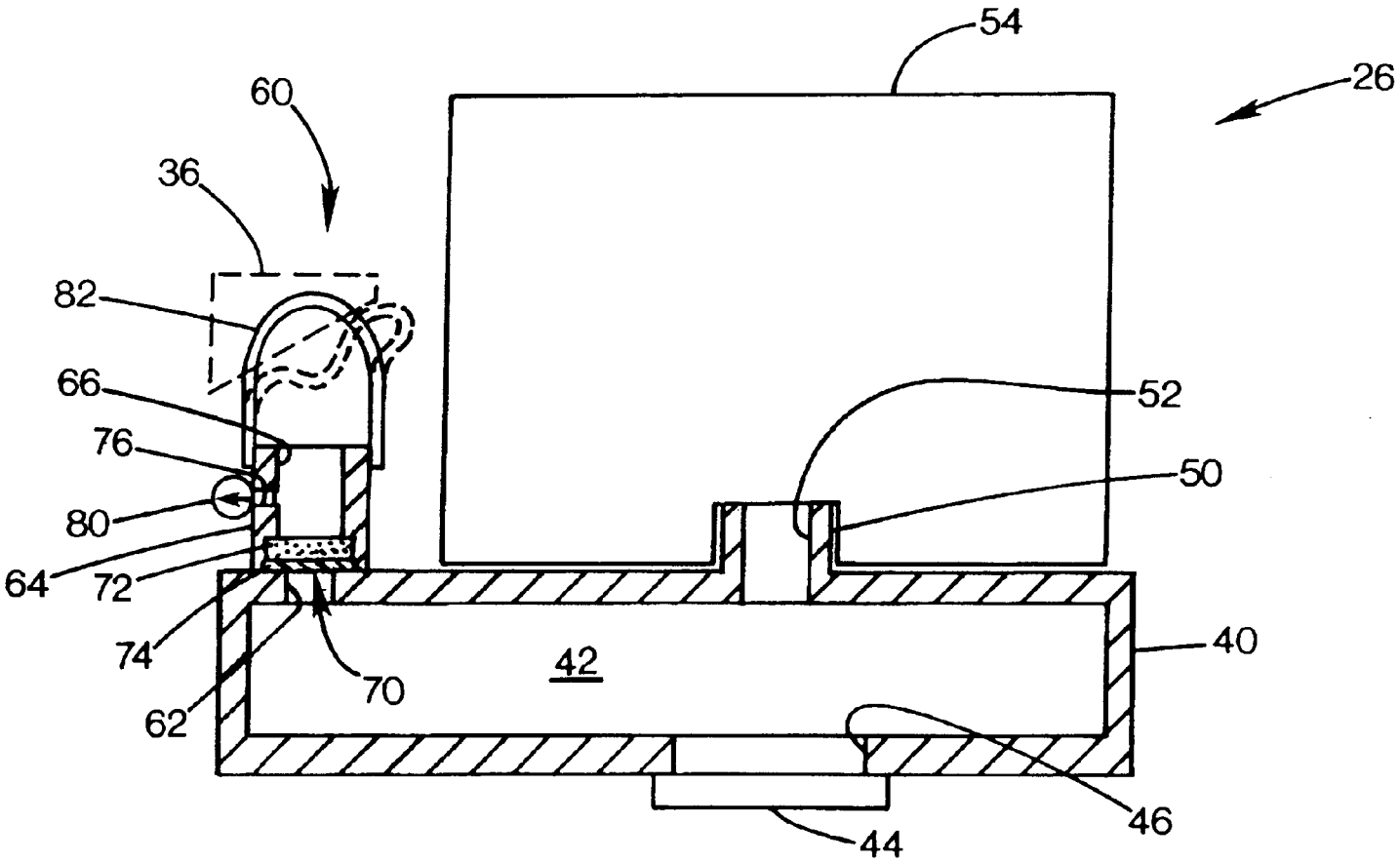
FIG. 2 is an enlarged sectional view of the embodiment of FIG. 1.

FIG. 2 shows the pen 26 in greater detail. The pen includes a pen body 40 defining an ink chamber 42 and having an ink jet print head 44 attached to a lower surface for communication with the ink chamber, which supplies ink to the interior side of the print head through a lower chamber opening 46. The pen body includes an upper standpipe 50 defining an ink inlet 52 that connects to a replaceable ink supply cartridge 54.

A suction generator 60 is connected to the pen body at a gas outlet aperture 62 defined in an upper wall of the pen body, where gas bubbles will tend to accumulate. The suction generator has a hollow cylindrical body 64 defining a bore 66 open at each end. At the lower end of the bore 66, which registers with the gas outlet aperture 62 of the pen body, the suction generator includes a barrier 70 that entirely blocks the passage between the ink chamber 42 and the bore 66.

The barrier 70 includes a porous support 72 that allows passage of air and provides support to a thin gas permeable film. A thin gas permeable film 74 that is impermeable to aqueous ink jet ink is applied to and supported by the porous support 72. Relative to the thin membrane film , the support plate is essentially rigid, protecting the film against damage during assembly, as well as rupture due to an excessive pressure differential. In the preferred embodiment, the porous support is formed of polypropylene, polyethylene or Polyvinledene flouride (PVdF). The support is 25–45 microns thick and has a porosity of over 20%.

The film of the preferred embodiment is a nonporous film formed of either Poly dimethyl silicone (PDMS) or Polytetra flouro ethylene (PTFE) (sold commercially under the trade name of Teflon AF®) and has a thickness of 3–15 microns. Such film is available from Compact Membrane Systems of Newark Delaware. In the preferred embodiment, the film is a 5 micron thick layer of Teflon AF® supported on the porous PVdF support. The area of the film portion exposed to the body aperture 62, and thus available for gas transmission, is approximately 5 square centimeters. Given the above specifications, at a pressure differential of 10 cm Hg, the film may transmit up to 1.34×10−2 cc/second. Other nonporous air-permeable films known in the art may also be used.

In the preferred embodiment, the suction generator body 64 defines an exhaust aperture 76 in one side to which is connected a check valve 80 that permits gas to exit the bore 66, but which does not admit gas. This ensures that the bore will not be pressurized above ambient pressure, and will maintain a partial vacuum needed to draw gas through the film over time. The check valve is illustrated schematically for clarity, and may be of any type, such as a reed valve, or an elastomeric flap lightly biased over the aperture on the exterior surface. A resilient elastomeric boot 82 has a convex dome shape, and enclosed the upper end of the bore 66. The boot has spring qualities that lead it to return to the original position shown in solid line, which provide a maximum volume of enclosed space within the suction device. Pressing on the boot to deflect it reduces the chamber volume, causes the displaced gas to be exhausted via the valve 80, and generates a partial vacuum when pressure on the boot is withdrawn.

The system of the preferred embodiment operates when the boot is either manually pressed by a user or printer actuator, or is automatically pressed by the stop element 36 when the pen carriage is moved to the end of its travel against the stop element (the stop element is shown rotated 90 degrees from its actual position for clarity of illustration). This displaces the boot to the position shown in dashed lines, in which the suction device volume is substantially reduced from the normal condition. When the carriage is withdrawn from the stop element, the boot remains in the compressed position, as the check valve and the slow permeation rate of the film prevent the boot from expanding. The spring forces of the boot bias it to return to the original position, generating a partial vacuum. This vacuum may range from 2 cm Hg to 12 cm Hg for device operation.

With the partial vacuum thus generated, any gas bubbles residing in the aperture 62 at the film lower surface will be gradually transmitted into the suction device. It is believed that this process requires significant time compared to the normal printing actions, and the vacuum must be maintained over an extended period of printing or idle storage of the printer.

However, because the volumes of gas is normally small, the low flow rate is adequate to transmit the volume of gas expected to be trapped or generated over the life of the device. When all gas is evacuated (or if no gas was present) the film blocks all fluid passage, and the suction device maintains the existing partial vacuum and reduced volume.

The vacuum may be regenerated, restored, and/or maintained at periodic intervals, depending on the permeation rate, and the expected rate of gas formation or trapping. The boot may be compressed each time the printer is turned on, then at time intervals, or may be compressed based on printer usage. A vacuum restoration process may be based on a function of elapsed time, printing amount, or other factors. Alternatively, the boot may be compressed at regular intervals much more frequently than required, such as after printing each swath or line, each page, or each printing job. This would result in the boot being compressed to a given state (such as shown in dashed lines), so that it departed from that condition only by a minimal amount, as would occur during the limited time interval. This is believed to provide a consistent and predictable pressure differential.

Figure 3:
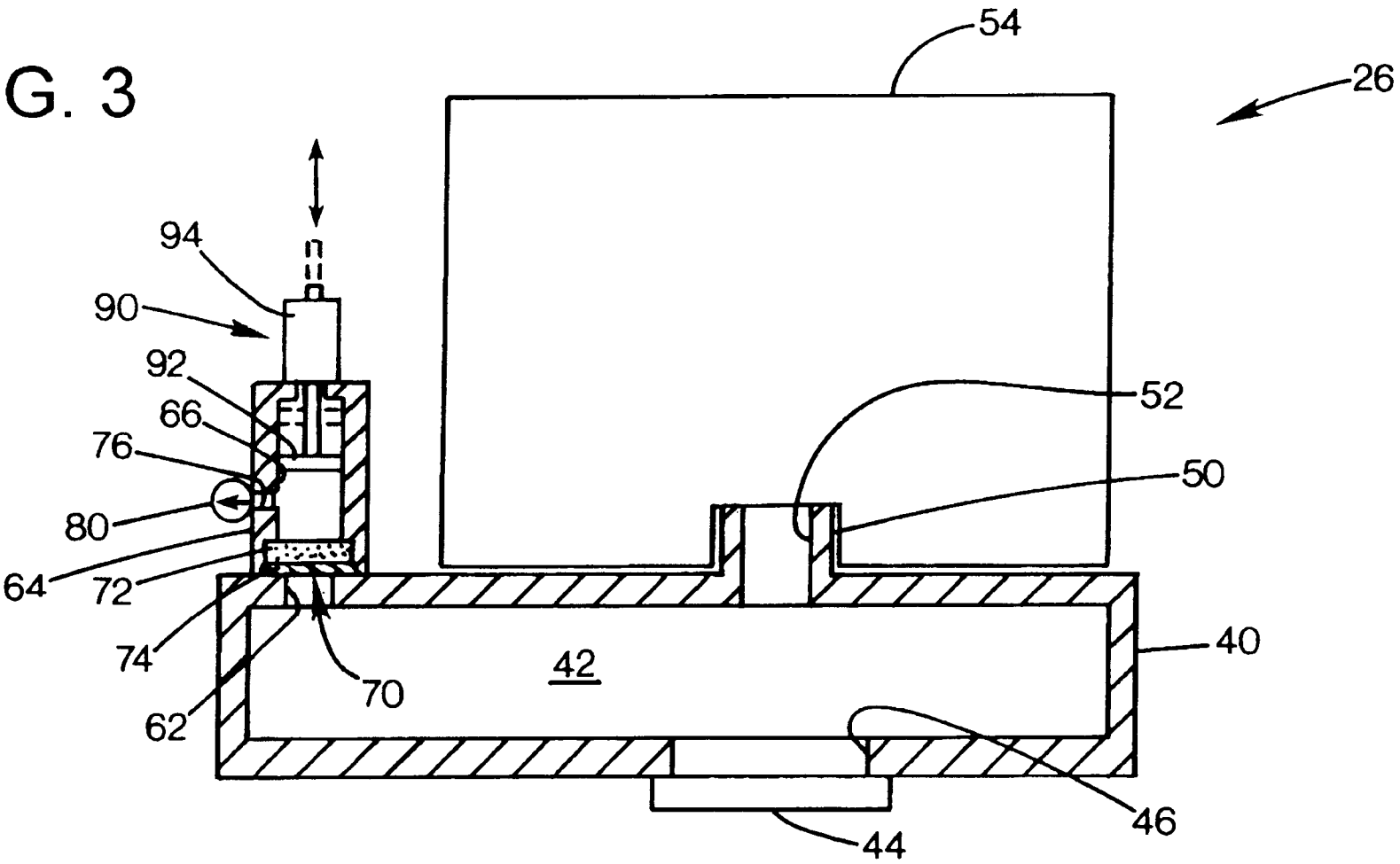
FIG. 3 is an enlarged sectional view of a printing system according to an alternative embodiment of the invention.

As shown in FIG. 3, the vacuum device need not be activated by motion of the carriage, but may employ any type of vacuum pump such as the pump 90. This alternate embodiment uses essentially the same body 64, but with a piston 92 operating within the bore, acuated by a solenoid, manually actuated spring, or other actuator 94. As above, the pump operates occasionally to generate a vacuum in the chamber, and maintains a position to hold the partial vacuum for a period of time to allow permeation of has through the film. At intervals, the acquired gas is exhausted by a down strike of the piston, and the vacuum restored by an upstroke. A multitude of alternative pump mechanisms are available, including diaphragm pumps, linear motor actuated pumps, gear pumps, syringe pumps and peristaltic pumps. In either embodiment, a sensor on the printer may operate to detect the excursion of the pump element or boot to a position that requires it to be re-actuated, either by an automatic actuator, by manual pressure, or by compression against the stop element.

While the above is discussed in terms of preferred and alternative embodiments, the invention is not intended to be so limited.

What is claimed is:

1. A printer, comprising:

a print engine;

an Ink supply chamber connected to the print engine;

the supply chamber defining an exit aperture;

a suction device in communication with the aperture, the suction device including a flexible resilient portion operable to generate suction in response to flexure of the resilient portion;

a gas permeable film associated with the aperture and separating the chamber from the suction device;

and wherein the suction device includes a check valve operable to exhaust gas through an exhaust aperture in response to flexure of the resilient portion, and to prevent incursion of gas via the exit aperture.

2. A printer, comprising:

a print engine;

an ink supply chamber connected to the print engine;

the supply chamber defining an exit aperture;

a suction device in communication with the aperture, the suction device including a flexible resilient portion operable to generate suction in response to flexure of the resilient portion;

a gas permeable film associated with the aperture and separating the chamber from the suction device;

the printer including a reciprocating carriage supporting the print engine and the suction device, and operable to reciprocate on a carriage path, and wherein the printer includes an actuator adjacent the carriage path in a position registered with the resilient portion, such that reciprocation of the carriage generates flexure of the resilient portion.

3. A method of evacuating gas from a printer ink supply chamber comprising:

defining an aperture in the chamber;

providing a suction chamber in communication with the aperture;

providing an air permeable film between the ink supply chamber and the suction chamber; and generating suction in the suction chamber to draw gas through the membrane while preventing ink from entering the vacuum chamber;

wherein providing suction includes flexing a movable portion of the suction chamber to expel gas from an exhaust aperture in the chamber, and wherein flexing a movable portion of the chamber includes reciprocating a carriage supporting the chamber to press the flexible portion against an obstruction.

4. A method of evacuating gas from a printer ink supply chamber comprising:

defining an aperture in the chamber;

providing a suction chamber in communication with the aperture;

providing an air permeable film between the ink supply chamber and the suction chamber; and generating suction in the suction chamber to draw gas through the membrane while preventing ink from entering the vacuum chamber;

wherein providing suction includes flexing a movable portion of the suction chamber to expel gas from an exhaust aperture in the chamber, and wherein generating suction in the suction chamber includes operating a check valve to exhaust gas through an exhaust aperture in response to flexure of the movable portion, and to prevent incursion of gas via the exit aperture.

* * * * *